United States Patent [19]

Senghaas et al.

[11] Patent Number: 4,516,911

[45] Date of Patent: May 14, 1985

[54] SOLID STATE CONTROL SYSTEM FOR OIL WELL BAILER PUMP

[75] Inventors: Karl A. Senghaas; Peter Senghaas, both of San Antonio, Tex.

[73] Assignee: Southwest Bailer Pump Company, San Antonio, Tex.

[21] Appl. No.: 566,831

[22] Filed: Dec. 29, 1983

[51] Int. Cl.[3] ..... F04B 41/06; F04B 49/00; E21B 27/00

[52] U.S. Cl. ..... 417/2; 417/12; 417/40; 417/410; 166/53; 166/75 R; 166/168

[58] Field of Search ..... 417/2, 12, 40, 410, 417/411, 415; 166/53, 72, 75 R, 168, 369; 294/68, 69 R, 72; 173/87; 254/276

[56] References Cited

U.S. PATENT DOCUMENTS

| | | | |
|---|---|---|---|
| 1,486,923 | 3/1924 | Ross | 254/276 |
| 2,316,494 | 4/1943 | Tipton | 417/2 |
| 2,462,571 | 2/1949 | Thompson et al. | 91/275 |
| 2,661,697 | 12/1953 | Long et al. | 417/410 |
| 2,956,511 | 10/1960 | Morehead | 417/415 |
| 3,938,595 | 2/1976 | Swenson | 173/87 X |
| 3,963,374 | 6/1976 | Sullivan | 417/12 |
| 3,998,568 | 12/1976 | Hynd | 417/12 |
| 4,037,662 | 7/1977 | Bowling | 166/168 X |
| 4,062,640 | 12/1977 | Gault | 74/589 X |
| 4,086,035 | 4/1978 | Klaeger et al. | 417/410 |
| 4,368,909 | 1/1983 | Alexander, Jr. | 417/410 X |

*Primary Examiner*—William L. Freeh
*Assistant Examiner*—Paul F. Neils
*Attorney, Agent, or Firm*—Fulbright & Jaworski

[57] ABSTRACT

A solid state switching controller for use with various types of oil well bailer pumps. Individually programmable steps with lockouts provide multiple mutual exclusivity between various circuit operations. A trickle charge battery system powers the control circuits. A tank overflow float protects against oil spillage. An automatic production rate adjustment circuit is provided which increases cycle time in proportion to the rate of production. The circuit includes a low power voltage detector for disabling the control circuits until the line voltage is acceptable. A three-phase power and control system with an isolation transformer for the controls avoids unreliable ground connections. The timers include a dividing circuit with an RC circuit. All power actuated apparatus are actuated by triac switches which are controlled by an opto driver. The bailer brake is pulse actuated for allowing the bailer to sink into crude oil without excess cable looseness.

11 Claims, 9 Drawing Figures

SOLID STATE CONTROL SYSTEM FOR OIL WELL BAILER PUMP

BACKGROUND OF THE INVENTION

It is well known, as shown in U.S. Pat. No. 4,086,035, to utilize a bailer pump for oil wells. Such systems utilize a reversible electric motor for lowering a bailer on a cable into a well where it is filled, raised, emptied, and recycled. Such systems are useful for recovering oil from shallow low yield wells.

However, bailer pump systems are typically operated in remote areas under adverse environmental conditions of heat and dust which exacts a high toll on electrical systems. In addition, while the above patented bailer pump works satisfactorily in lighter or less viscous oil, difficulty was encountered in attempting to get the bailer to sink into viscous oil without overloosening the tension in the cable.

The present invention is generally directed to a solid state control system for an oil well bailer which is adapted to work with various types of bailer pumps, is programmable to optimize oil well production at a minimum cost, and provides electrical components and features which are able to withstand the harsh environmental conditions under which the control system continuously works.

SUMMARY

The present invention is directed to a control system for an oil well bailer pump having a reversible motor for actuating a cable for lowering a bailer into an oil well, filling the bailer, raising the bailer, and dumping the oil into a tank and recycling. The system controls a series of operations which are individually and adjustably timed and which sequentially switch on the next operation to provide an overall sequence designed to operate a bailer pump. The system includes a winch up circuit for actuating the motor to raise the bailer, an up overshoot circuit for opening the bailer for emptying oil therefrom in which the overshoot circuit is actuated by the end of the winch up circuit. An up hold circuit directs the draining oil into the tank and is actuated by the end of the overshoot circuit. A winch down circuit lowers the bailer to the surface of the oil in the well and is actuated in response to the up hold circuit. A down overshoot circuit lowers the bailer a predetermined distance below the oil level in the well for filling the bail and is actuated in response to the end of the winch down circuit. A down hold circuit allows time for the bail to fill and also time to dump the holding tank if it is filled. The down hold circuit is actuated by the end of the down overshoot circuit.

Still a further object of the present invention is wherein individual adjustable timers are connected to each of the winch up, up overshoot, up hold, winch down, down overshoot and down hold circuits. Preferably, the adjustable timers include a dividing circuit with an RC circuit.

Still a further object of the present invention is the provision of mutual exclusive circuit dominance provided by enable and disable circuits for providing proper sequence of operation of the system. For example, disable circuits are provided between the winch up and winch down circuits to prevent them from being simultaneously actuated.

A still further object is the use of a proximity switch to detect the winch up position for avoiding the use of mechanically actuated limit switches.

Still a further object of the present invention is the provision of the cycling of the winch brake when the bailer is stopped at the fluid level to allow the bail to gradually sink into highly viscous crude without relaxing the winch cable tension to a point where it might foul.

Yet a still further object of the present invention is the provision of an automatic production rate adjustment wherein the cycling time of the bailer may be increased during the hold down operation in the event that the rate of production is low thereby avoiding wasting energy.

Still a further object of the present invention is the provision of a low power line voltage detector which stops operation until acceptable line voltage is restored thereby preventing motor stalling or overheating.

A still further object of the present invention is the provision of a battery backup which is trickle charged to power the controls so that the control memory will be maintained even in the event that power voltage is lost.

Yet a further object is the provision of an overflow float which prevents oil spills by shutting down the pumping system in the event of failure.

A further object of the present invention is wherein all of the power actuated equipment is actuated by triac switches which in turn are controlled by opto drivers for reducing the heat load in the controller.

Other and further objects, features and advantages will be apparent from the following description of a presently preferred embodiment of the invention, given for the purpose of disclosure and taken in conjunction with the accompanying drawings where like character references designate like parts throughout the several views.

DESCRIPTION OF THE PREFERRED EMBODIMENT

Figure 1:
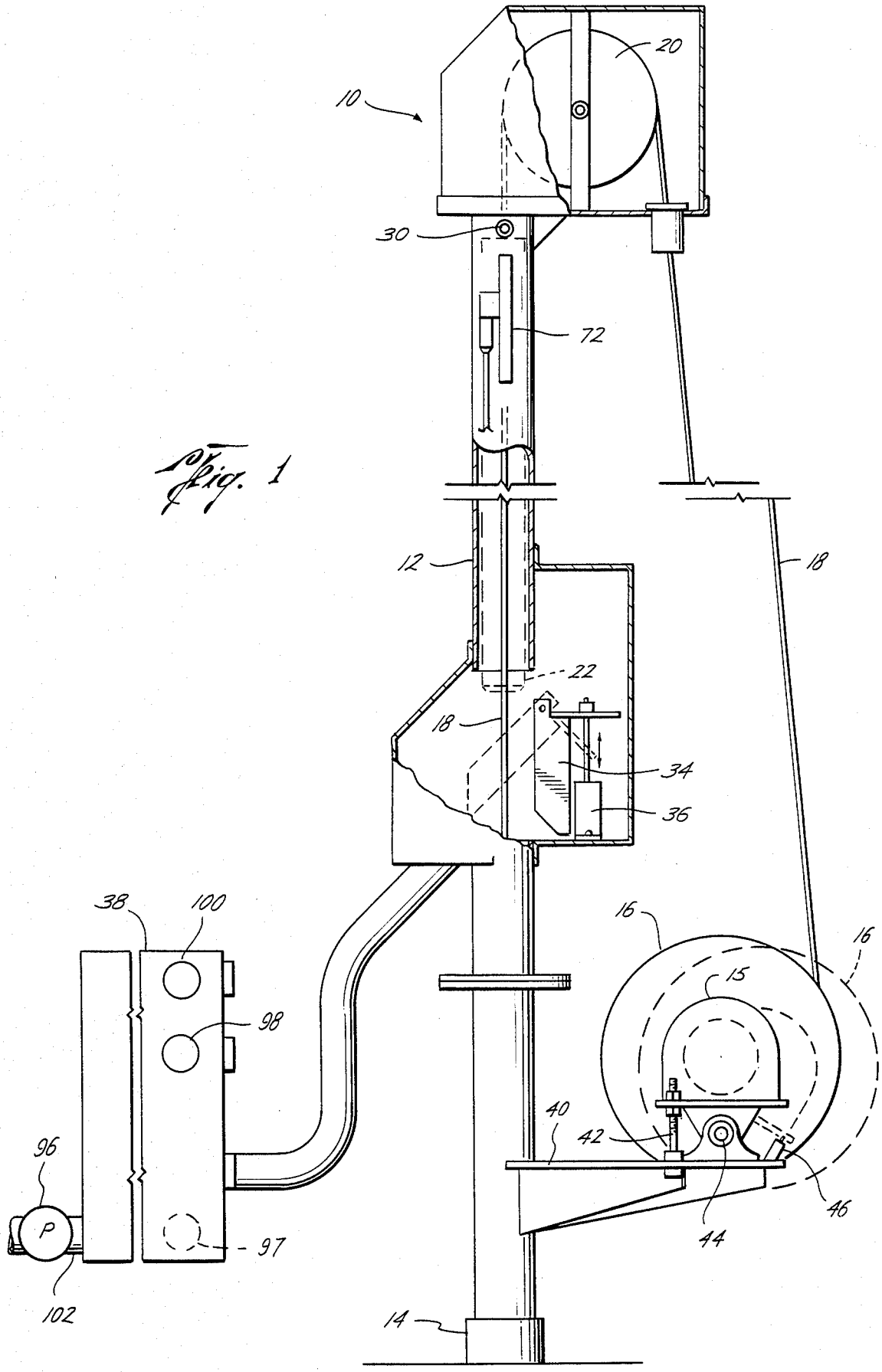
FIG. 1 is an elevational view, partly in cross section, illustrating one type of oil well bailer pump.
Figure 2:
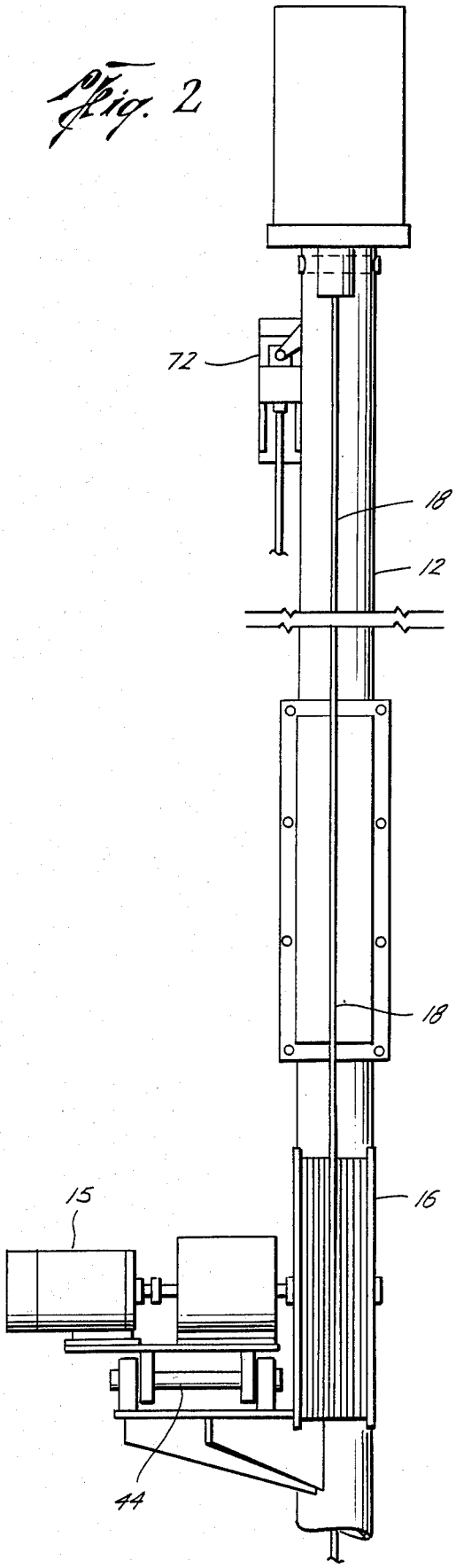
FIG. 2 is a side elevational view of the apparatus of FIG. 1.
Figure 3:
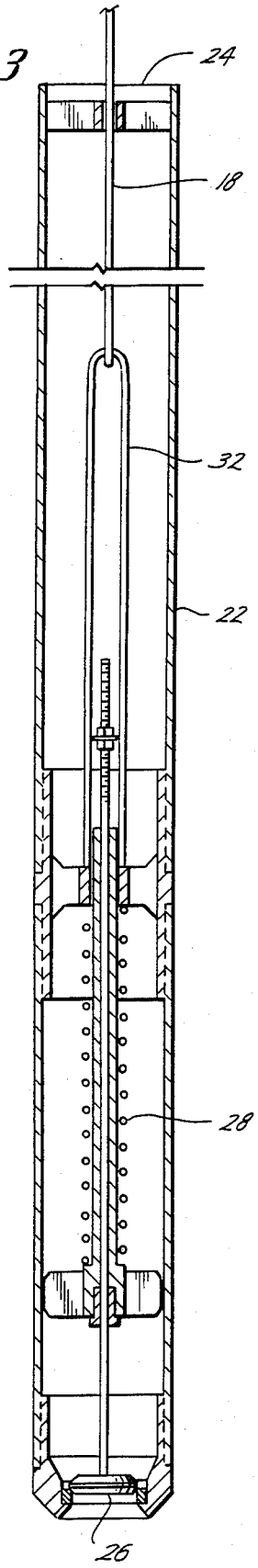
FIG. 3 is an enlarged cross-sectional view of a suitable type of bailer for use in the apparatus of FIGS. 1 and 2.

Referring now to the drawings, and particularly to FIGS. 1, 2 and 3, an oil well bailer pump is generally indicated by the reference numeral 10 and includes a stand pipe 12 connected to a wellhead 14, a reversible motor 15 driving a winch 16 which reels in and unreels a cable 18 carried over a pulley 20 and connected in the well to a bailer 22. The motor 15 is actuated to lower the bailer 22 into the oil. The oil flows into the top 24 of the bailer 22 with the bottom being closed by a valve 26 which is normally held in the closed position by gravity. Oil flows into the top 24 of the bailer 22 by gravity. After filling, the motor 15 is reversed, winds up the cable 18 and lifts the bailer 22 up to the top of the stand pipe 12. The top of the bailer 22 engages a stop 30 and a further pull on the cable 18 pulls the slide 32 upwardly moving the valve element 26 off of its seat and opening the bottom of the bailer 22.

A dump pan 34 is energized by solenoid 36 to move into the position indicated in the dotted outline (FIG. 1) to receive the oil which is dumped from the bailer 22 and diverts the oil into a oil holding tank 38. The dump 34 is then retracted out of the way and the cycle is repeated. Various types of oil well bailer pumps are disclosed in U.S. Pat. Nos. 4,037,662; 4,086,035 and 4,368,909. The present invention is useful in controlling various types of bailer pumps. For example, referring to FIG. 1, the controller is suitable for controlling the pump 10 in its preferred embodiment with the motor 15 fixedly secured to a support 40 connected to the stand pipe 12 by a bolt and nut connection 42. The bolt and nut connection 42 may be omitted and the motor 16 is allowed to pivot about the support rod 44. In this mode of operation, the motor 16 remains substantially upright as the bailer 22 is raised and lowered in the well. However, when the bailer 22 on downward movement impacts on the oil, the tension in the cable 18 decreases, the motor 16 rotates to the dotted position and actuates a limit switch 46 which initiates other steps in the operation. Thus the limit switch 46 acts similar to the tiltable arm in Pat. No. 4,086,035.

Figure 4:
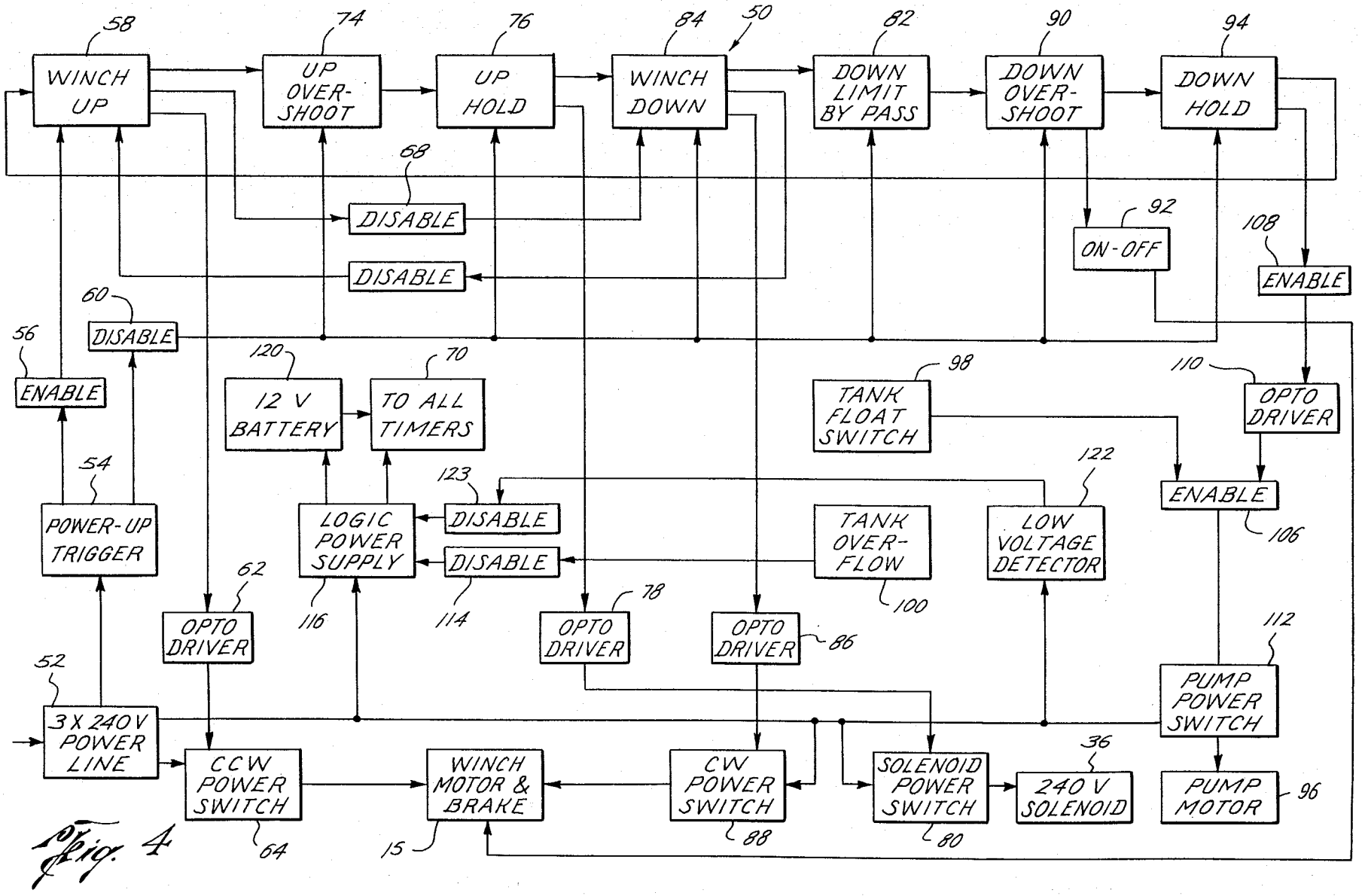
FIG. 4 is an electrical block diagram of the controller of the present invention.

The present invention is directed to a control system that can control and operate various types of bailer pumps including the pump 10 operated in either of the above two described operating modes. Referring now to FIG. 4, the schematic of the present control system, is generally indicated by the reference numeral 50 and includes a plurality of operations which sequentially actuate another operation and each is self-adjustable as to time to satisfy the operating requirements of any particular well. The system 10 utilizes three phase power as indicated at block 52 to actuate a power up trigger 54 which in turn actuates an enable circuit 56 to start the operation by starting a winch up circuit 58. Simultaneously, the power up trigger 54 actuates a disable circuit 60 to disable other operations to insure that the proper sequence of operation is maintained. The winch up circuit 58 actuates an opto driver 62 and power switch 64 to rotate the winch motor 15, as best seen in FIG. 1, in a counterclockwise direction to raise the bailer 22 up the well. At the same time, the winch up circuit actuates a disable circuit 68 to disable the winch down circuit 84 to positively prevent that function from being accidentally turned on. The winch up circuit 58 is controlled by one of the individual timers in the timer 70 block, which will be more fully discussed hereinafter. Each individual timer is separately adjustable. For example, the time setting for the timer controlling the winch up circuit 58 may have time settings from zero to ten minutes. Operation of the winch up circuit 58 lifts the bailer 22 to the well surface in the stand 12. However, while the timer may be the sole control for positioning the bailer 22 in the up position, normally an upper limit switch 72 (FIGS. 1 and 2) which is preferably a proximity switch is utilized and is actuated by the presence of the bailer 22 at the position of the proximity switch 72 which assures the full positional accuracy of the bailer 22 for a proper draining position. The proximity switch 72 avoids the adjustment problems of mechanical type limit switches which wear out with continuous use. With the use of the proximity switch 72 the timer to the winch up circuit 58 functions as a delayed safety shut-off. An up overshoot circuit 74 is actuated by either the end of the winch up cycle 58 or the limit switch 72. The up overshoot circuit 74 is also controlled by an adjustable timer, for example, a timing setting of 0.1 to 1.0 seconds. The up overshoot circuit 74 raises the bailer 22, as best seen in FIG. 1 into engagement with the stop 30 and thereafter opens the valve 26 (FIG. 3) to allow oil to drain from the bottom of the bailer 22. The up overshoot circuit 74 actuates an up hold circuit 76. The up hold circuit 76 actuates an opto driver 78 and a solenoid power switch 80 for actuating the solenoid 36 (FIG. 1) to move the dump 34 into a position under the bail 22 so that the released oil is drained to the holding tank 38. The up hold circuit 76 also is controlled by an adjustable timer which may have a suitable time setting such as 3 to 240 seconds for allowing disposal of the bailed oil.

In the embodiment wherein a limit switch 46 is used (FIG. 1) the up hold circuit 76 triggers a down limit bypass circuit 82 as well as the winch down circuit 84 after the solenoid power switch 80 has been deactuated to move the dump 34 out of position from underneath the bail 22. The down limit bypass circuit 82 does not have an adjustable timer, but has a fixed time, such as 3 seconds, to provide the system 50 with immunity of interference by the low limit switch 46 as the winch 16 reacts to the winch down movement caused by the circuit 84. However, circuit 82 may be omitted if switch 46 is not used.

The winch down circuit 84 actuates an opto driver 86 and a clockwise power switch 88 to rotate the winch motor 15 to drive the winch 16 in a direction to lower the bail 22 into the well. Again, an adjustable timer is connected to the winch down circuit 84, such as a setting from zero to ten minutes to lower the bail to adjacent the surface of the oil in the well. As an alternative, referring to FIG. 1, the bolt and nut connection 42 may be omitted and the lower limit switch utilized which will be actuated when the bail 22 hits the surface of the oil and allows the winch 16 to pivot around as the cable 18 loses tension to actuate the limit switch 46 and stop the winch down circuit 84.

A down overshoot circuit 90 is actuated by the end of the winch down circuit 84 or the lower limit switch 46 to allow the bail 22 to drop a measured distance below the liquid level in the well and fill the bail 22 with oil by gravity. In light oil, the bail 22 will readily sink into the oil and be filled with oil. However, in the case of heavy highly viscous crude oil, the bail 22 will be slow to sink into the oil. Therefore, as an option, the winch brake of the winch motor 15 is cycled on and off, for example one second on and one second off, by an on-off circuit 92 to allow the bail 22 to gradually sink into the heavy crude without relaxing the cable 18 which might cause it to come off of the pulley 20 or winch 16 or become fouled. The down overshoot circuit is also controlled by an adjustable timer which may be suitably set, such as from 3 to 240 seconds. The end of the down overshoot circuit 90 actuates the down hold circuit 94 which is controlled by an automatic timer with suitable settings, such as from half a minute to 120 minutes. The time is set to allow the bail 22 to fill or provide time between cycles for slower than maximum pumping rate. In addition, the down hold time should be sufficient to allow a pump 96 to transfer oil from the solenoid tank 38 to a remote storage tank.

Figure 5:
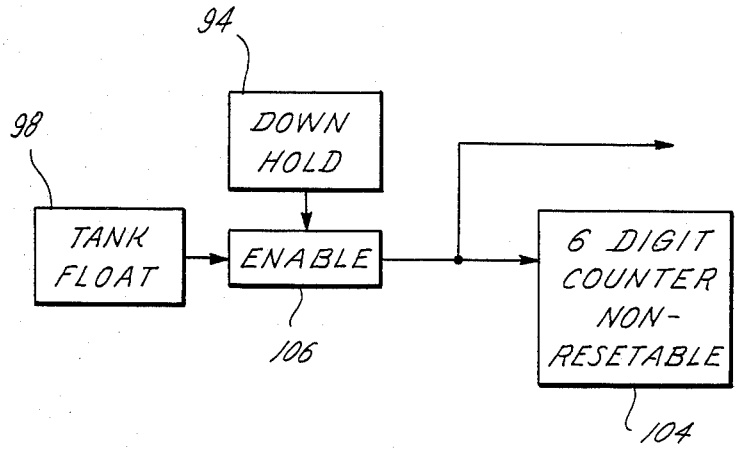
FIG. 5 is an electrical block diagram of a circuit for automatically counting and measuring the amount of produced oil.

Because of the interaction between the down hold circuit 94 and the transfer of oil from the holding or setting tank 38, a discussion of the operation of the settling tank 38 is best seen from FIG. 1 and from the schematic of FIG. 5 which may be used to automatically record the amount of oil pumped into storage from the settling tank 38. The settling tank 38 receives the oil dumped from the bailer 22 and includes a float switch 98 with a low float position 99 and an overflow float switch 100. The float switch 98 enables the pump 96 when the amount of oil in the settling tank 38 rises to its high position, and disables the pump in its low position 99. The amount of oil between the float 98 high position and the float 99 low position may be calibrated and a counter 104 provided to be actuated each time the settling tank 38 is emptied by the pump 96 to provide a record of the total amount of oil from the settling tank 38 and thus of the particular well. That is, when a sufficient amount of oil enters the settling tank 38 to actuate the high float 98, the float 98 actuates one input terminal of an enable circuit 106. When the down hold circuit 94 is energized it actuates a first enable circuit 108 which in turn actuates an opto driver circuit 110 and provides the second input to the enable circuit 106. With both the tank high float 98 actuated, and the down hold circuit 94 actuated, the pump 96 is actuated by the pump power switch 112 to empty the settling tank 38 and low float switch position 99 turns off pump 96. The time setting of the timer for the down hold circuit 94 must be sufficient to allow the pump 96 to complete its transfer. That is, the bailer 22 remains down in order to prevent any additional oil from being added to the tank 38 while the transfer is taking place.

The float switch 100 is an overflow switch that is provided to prevent the tank 38 from being overfilled in the case of a failure such as the float switch 98 failing or the pump 96 failing. In such an event the overflow switch 100 (FIGS. 1 and 4) will actuate a disable circuit 114 to disable the logic power supply 116 in order to prevent oil spillage on the ground.

Figure 6:
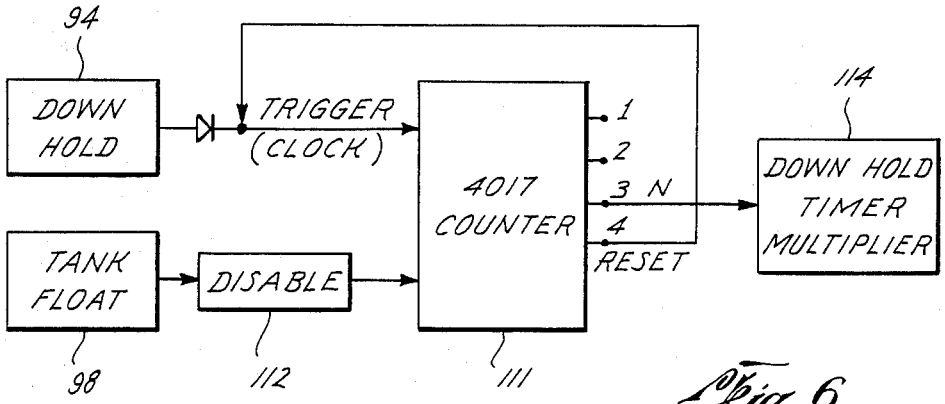
FIG. 6 is an electrical block diagram of the automatic production rate adjustment circuit of the present invention.

Another feature of the present invention is the provision of an automatic production rate adjustment for avoiding wasting energy. That is, it is wasteful to cycle the bailer 22 in terms of energy at such a fast rate that the bailer is only slightly filled. The automatic production rate adjustment circuit, as best seen in FIG. 6, is provided in which the holddown circuit 94 will trigger or clock a counter 111 by one step each time the bailer pump 10 completes a cycle. However, the counter 111 will be disabled and reset by the action of the tank float 98 measuring a tank full of oil and transferring it from the settling tank 38. In such an event, the tank float will actuate a disable circuit 112 for disabling and resetting the counter 111. However, unless the tank float 98 is actuated as a result of sufficient production, after a predetermined number of winch cycles, the counter 10 will actuate and extend the down hold time by actuating a multiplier 114 thereby allowing the bailer 22 to await production by the well and become more full. Thus the winch cycle rate is automatically set to agree with the well production and save the energy of operating the bailer pump 10 as well as wear and tear on the system.

Referring now to FIG. 4, a battery system 120, such as a 12-volt system, is provided which receives a trickle charge from the logic power supply 116 and supplies direct current to all control functions. This feature enables the controller 50 to function reliably even though the alternating current supply 52 fluctuates. Also, the 12-volt battery maintains the memory program status during power failures and thereby keeps the control and production synchronized with the actual hardware status.

A low voltage detection circuit 122 is connected to and monitors the incoming power circuit 52. In the event that the incoming power 52 has unacceptable low voltage, the control 122 will cut off the system 50 by actuating disable circuit 123 until acceptable line voltage level is restored. This will prevent motor stalling or overheating. However, the sequence of operation will not be upset because of this power shutdown as the battery 120 provides the power to the control circuits to hold the program status and sequencing until the power 52 is properly restored.

Figure 7:
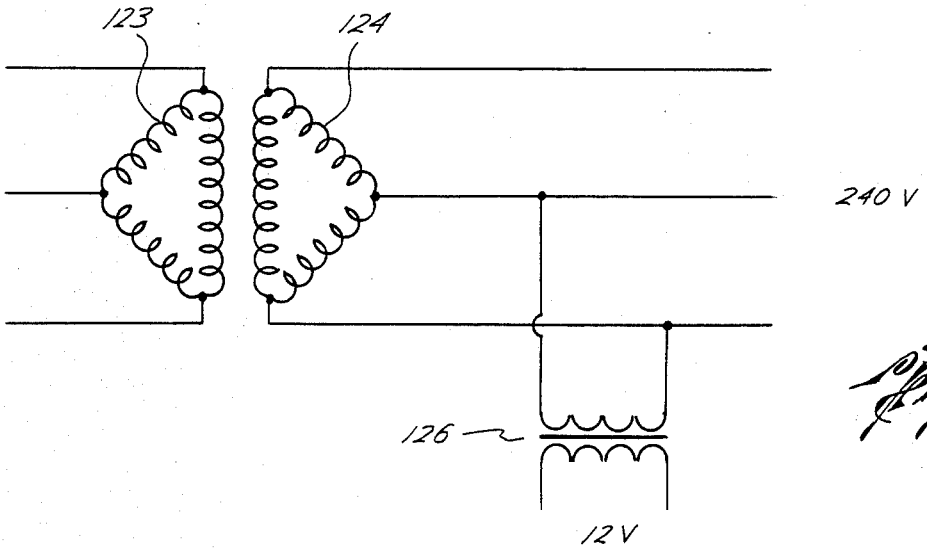
FIG. 7 is a schematic of the power and control supply system for avoiding the use of a ground connection.

Normally, in using three-phase power, reduced power levels are obtained by providing a circuit between one of the phases and ground. However, in remote arid regions, ground connections are unreliable and thus the power supply between ground and one phase becomes unreliable. The present power system for providing lower level power from the three-phase line is accomplished through a delta to delta connection and a separate isolation transformer to avoid larger voltage variations. Referring now to FIG. 7, a three-phase conventional delta to delta power connection is shown having primary 123 and secondary 124 connections to provide the three-phase power. However, in addition, an isolation transformer 126 is provided between two phases of the secondary to provide the control logic power supply, and utilizing the ground only as a safety device.

Figure 8:
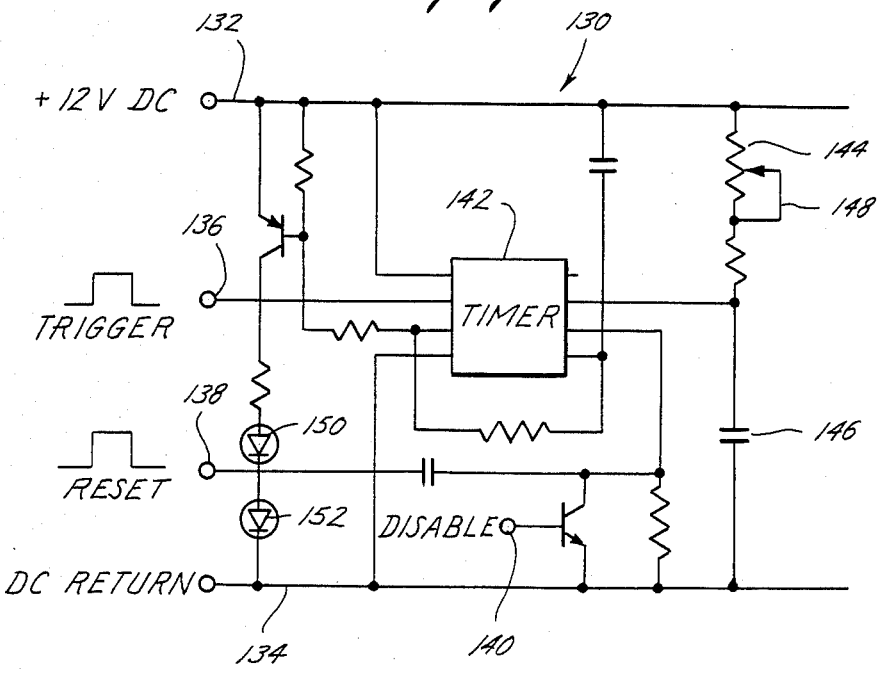
FIG. 8 is an electrical schematic of a typical timer circuit.

Referring now to FIG. 8, a typical timer circuit is illustrated for the timers which are connected to the winch up circuit 58, the up-overshoot circuit 74, the up hold circuit 76, the winch down circuit 84, the down overshoot circuit 90 and the down hold circuit 94. The timer, generally indicated by the reference numeral 130 is powered from 12-volt dc circuit 120 between the lines 132 and 134. The timer is actuated by a trigger signal applied to lead 136 and may be reset by a signal on lead 138. A disable lead 140 is provided for disabling the timer and its attendant function. The timer basically consists of a plurality of divide by flip-flop circuits such as timer 142 which may be integrated circuit 2243 which is connected to an RC circuit consisting of a resistor 144 and a capacitor 146. A potentiometer 148 adjusts the time by adjusting the resistance. The timer circuit includes a status LED 150 to indicate when the timer is actuated and includes an opto driver 152 for actuating power equipment to its connected circuit.

Figure 9:
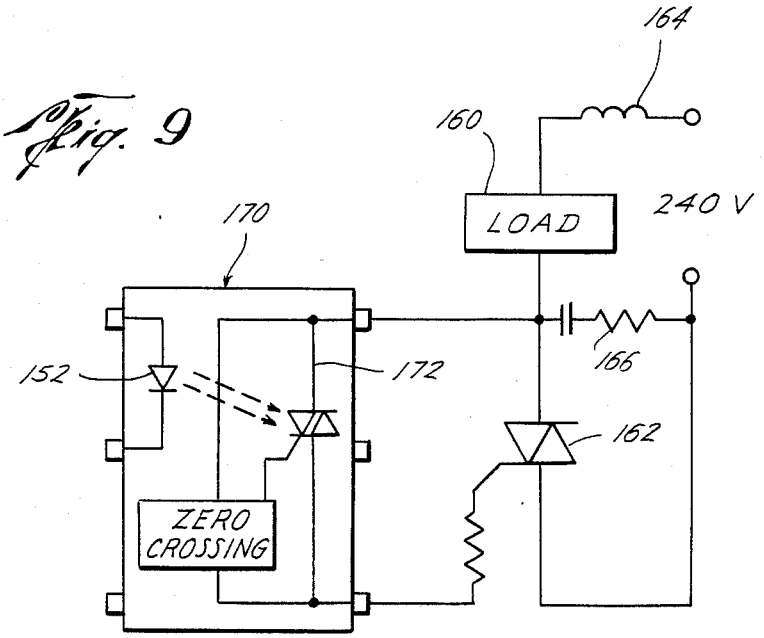
FIG. 9 is an electrical schematic of a typical opto driver and power stage.

It is desirable, as the bailer pump 10 is generally located in a remote hot area, to generate as little heat as possible. Therefore, referring to FIG. 9, the load 160 such as the bailer motor 15 or pump 96 or solenoid 36 is actuated from a power triac 162. Preferably, the power circuit includes an rf filter or choke 164 for removing spikes and includes a snubber circuit 166. The snubber circuits assure correct triac switching under adverse phase conditions such as during winch down when a poor power factor exists.

The power circuit is actuated by an opto isolated driver generally indicated by the reference numeral 170 which is generally integrated circuit MOC3041 wherein actuation of the opto driver 152 in the timer 130 provides a light pulse to the drive circuit 172 to turn on the power triac 162 and provide power to the load 160.

The present invention, therefore, is well adapted to carry out the objects and attain the ends and advantages mentioned as well as other inherent therein. While a presently preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. An electric control system for an oil well bailer pump having a reversible electric motor for actuating a cable for lowering a bailer into an oil well, filling the bailer, raising the bailer, and dumping the oil into a tank and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil into the tank and actuated by the end of the overshoot circuit, a winch down circuit for lowering the bailer to the surface of the oil in the well, said winch down circuit actuated in response to the up hold circuit, a down overshoot circuit for lowering the bailer a predetermined distance below the oil level in the well for filling said bail with oil, said down overshoot circuit actuated in response to the end of the winch down circuit, a down hold circuit for allowing time for the bailer to fill, said down hold circuit actuated by the end of the down overshoot circuit, said down hold circuit actuating the winch up circuit, and individual adjustable timers connected to each of the winch up, up overshoot, up hold, winch down, down overshoot and down hold circuits.

2. The apparatus of claim 1 wherein the time circuits include, a dividing circuit and an RC circuit.

3. An electric control system for an oil well bailer pump having a reversible electric motor for actuating a cable for lowering a bailer into an oil well, filling the bailer, raising the bailer, and dumping the oil into a tank and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil into the tank and actuated by the end of the overshoot circuit, a winch down circuit for lowering the bailer to the surface of the oil in the well, said winch down circuit actuated in response to the up hold circuit, a down overshoot circuit for lowering the bailer a predetermined distance below the oil level in the wall for filling said bail with oil, said down overshoot circuit actuated in response to the end of the winch down circuit, a down hold circuit for allowing time for the bailer to fill, said down hold circuit actuated by the end of the down overshoot circuit, said down hold circuit actuating the winch up circuit, a three phase alternating current power source for providing power to the system, a battery receiving a trickle charge from the alternating current power, said battery connected to and powering the control circuits whereby loss of alternating current power will not cause loss of sequence operation.

4. The apparatus of claim 3 including, an overflow float connected to the tank and when actuated disabling said control system whereby failures in the pump or other controls will not cause the tank to overflow.

5. An electric control system for an oil well bailer pump having a reversible electric motor for actuating a cable for lowering a bailer into an oil well, filling the bailer, raising the bailer, and dumping the oil into a tank and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil into the tank and actuated by the end of the overshoot circuit, a winch down circuit for lowering the bailer to the surface of the oil in the well, said winch down circuit actuated in response to the up hold circuit, a down overshoot circuit for lowering the bailer a predetermined distance below the oil level in the well for filling said bail with oil, said down overshoot circuit actuated in response to the end of the winch down circuit, a down hold circuit for allowing time for the bailer to fill, said down hold circuit actuated by the end of the down overshoot circuit, said down hold circuit actuating the winch up circuit, pump means connected to the tank for emptying said tank, a float in the tank connected to and actuating said pump when the oil in the tank actuates the float, said pump means enabled only when the control system is in the down hold circuit cycle.

6. The apparatus of claim 5 including an automatic production rate adjustment circuit including, a counter which is connected to a multiplier for increasing the period of time of the timer for the down hold circuit, said counter being actuated by the tank float unless the tank float is actuated by a full tank within a predetermined number of cycles thereby reducing the cycle rate.

7. An electric control system for an oil well bailer pump having a reversible electric motor for actuating a cable for lowering a bailer into an oil well, filling the bailer, raising the bailer, and dumping the oil into a tank and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil into the tank and actuated by the end of the overshoot circuit, a winch down circuit for lowering the bailer to the surface of the oil in the well, said winch down circuit actuated in response to the up hold circuit, a down overshoot circuit for lowering the bailer a predetermined distance below the oil level in the well for filling said bail with oil, said down overshoot circuit actuated in response to the end of the winch down circuit, a down hold circuit for allowing time for the bailer to fill, said down hold circuit actuated by the end of the down overshoot circuit, said down hold circuit actuating the winch up circuit, and a disable circuit connected between the winch up and winch down circuit whereby when one of said winch up and winch down circuit is actuated the other is disabled from simultaneously being actuated.

8. An electric control system for an oil well bailer pump having a reversible electric motor for actuating a cable for lowering a bailer into an oil well, filling the bailer, raising the bailer, and dumping the oil into a tank and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil into the tank and actuated by the end of the overshoot circuit, a winch down circuit for lowering the bailer to the surface of the oil in the well, said winch down circuit actuated in response to the up hold circuit, a down overshoot circuit for lowering the bailer a predetermined distance below the oil level in the well for filling said bail with oil, said down overshoot circuit actuated in response to the end of the winch down circuit, a down hold circuit for allowing time for the bailer to fill, said down hold circuit actuated by the end of the down overshoot circuit, said down hold circuit actuating the winch up circuit, all power actuated apparatus is actuated by triac switches, and an opto driver connected to each of the triac switches for actuating said power triacs.

9. An electric control system for an oil well bailer pump having a reversible electric motor for actuating a cable for lowering a bailer into an oil well, filling the bailer, raising the bailer, and dumping the oil into a tank and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil into the tank and actuated by the end of the overshoot circuit, a winch down circuit for lowering the bailer to the surface of the oil in the well, said winch down circuit actuated in response to the up hold circuit, a down overshoot circuit for lowering the bailer a predetermined distance below the oil level in the well for filling said bail with oil, said down overshoot circuit actuated in response to the end of the winch down circuit, a down hold circuit for allowing time for the bailer to fill, said down hold circuit actuated by the end of the down overshoot circuit, said down hold circuit actuating the winch up circuit, and the reversible motor includes a brake and including, means for cycling the brake on and off during the down overshoot cycle allowing the bailer to gradually sink into various crude oil without excess looseness in the cable.

10. An electric control system for an oil well bailer pump having a reversible electric motor for actuating a cable for lowering a bailer into an oil well, filling the bailer, raising the bailer, and dumping the oil into a tank and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil into the tank and actuated by the end of the overshoot circuit, a winch down circuit for lowering the bailer to the surface of the oil in the well, said winch down circuit actuated in response to the up hold circuit, a down overshoot circuit for lowering the bailer a predetermined distance below the oil level in the well for filling said bail with oil, said down overshoot circuit actuated in response to the end of the winch down circuit, a down hold circuit for allowing time for the bailer to fill, said down hold circuit actuated by the end of the down overshoot circuit, said down hold circuit actuating the winch up circuit, a low power voltage detector, said detector connected to and disabling the control circuits until an acceptable line voltage level is restored.

11. An electric control system for an oil well bailer pump having a reversible electric motor for actuating a cable for lowering a bailer into an oil well, filling the bailer, raising the bailer, and dumping the oil into a tank and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil into the tank and actuated by the end of the overshoot circuit, a winch down circuit for lowering the bailer to the surface of the oil in the well, said winch down circuit actuated in response to the up hold circuit, a down overshoot circuit for lowering the bailer a predetermined distance below the oil level in the well for filling said bail with oil, said down overshoot circuit actuated in response to the end of the winch down circuit, a down hold circuit for allowing time for the bailer to fill, said down hold circuit actuated by the end of the down overshoot circuit, said down hold circuit actuating the winch up circuit, and a power and control system power supply without a ground having a three phase delta to delta voltage supply including an isolation transformer connected to one phase of the voltage supply thereby avoiding a ground connection.

* * * * *

UNITED STATES PATENT OFFICE
CERTIFICATE OF CORRECTION

Patent No. 4,516,911 Dated May 14, 1985

Inventor(s) Karl A. Senghaas and Peter Senghaas

It is certified that error appears in the above-identified patent and that said Letters Patent are hereby corrected as shown below:

Column 3, line 41, delete the comma after "system"

Column 7, line 7, change "drive" to --driver--

Column 8, line 1, change "wall" to --well--

Signed and Sealed this

*Third* Day of *September 1985*

[SEAL]

*Attest:*

DONALD J. QUIGG

*Attesting Officer* *Acting Commissioner of Patents and Trademarks - Designate*